US011549159B2

(12) United States Patent
Kinzel

(10) Patent No.: US 11,549,159 B2
(45) Date of Patent: Jan. 10, 2023

(54) METHOD OF OPERATING A SINTER PLANT

(71) Applicant: PAUL WURTH S.A., Luxembourg (LU)

(72) Inventor: Klaus Peter Kinzel, Sandweiler (LU)

(73) Assignee: PAUL WURTH S.A., Luxembourg (LU)

( * ) Notice: Subject to any disclaimer, the term of this patent is extended or adjusted under 35 U.S.C. 154(b) by 455 days.

(21) Appl. No.: 16/615,848

(22) PCT Filed: May 18, 2018

(86) PCT No.: PCT/EP2018/063045
§ 371 (c)(1),
(2) Date: Nov. 22, 2019

(87) PCT Pub. No.: WO2018/215327
PCT Pub. Date: Nov. 29, 2018

(65) Prior Publication Data

US 2020/0102627 A1 Apr. 2, 2020

(30) Foreign Application Priority Data

May 22, 2017 (LU) ..... 100 260

(51) Int. Cl.
*C22B 1/20* (2006.01)
*F27B 21/00* (2006.01)

(52) U.S. Cl.
CPC ..... *C22B 1/20* (2013.01); *F27B 21/00* (2013.01)

(58) Field of Classification Search
None
See application file for complete search history.

(56) References Cited

U.S. PATENT DOCUMENTS 2,035,845 A * 3/1936 Stanton ..... C04B 20/06 264/43
3,168,254 A * 2/1965 Kilboy ..... C22B 1/16 241/24.1
6,451,250 B1 * 9/2002 Hums ..... C22B 1/205 419/56
2020/0102627 A1 * 4/2020 Kinzel ..... F27B 21/00

FOREIGN PATENT DOCUMENTS

CN 102978313 A 3/2013
CN 104789718 A 7/2015
(Continued)

OTHER PUBLICATIONS

International Search Report dated Jul. 25, 2018 re: Application No. PCT/EP2018/063045, pp. 1-3, citing: DE 23 33 560 A1 and DE 44 14 32 A1.

(Continued)

*Primary Examiner* — Scott R Kastler
(74) *Attorney, Agent, or Firm* — Cantor Colburn LLP

(57) ABSTRACT

The invention concerns a method of operating a sinter plant, where a sinter mix is fired in a sintering machine, the method including crushing fired sinter to below an upper particle size limit;

screening the crushed sinter to remove fines and separate at least two sinter size fractions, typically smaller, intermediate and upper size fractions;

storing each of the at least two sinter size fractions in a respective, separate storage bin, where the screened sinter fractions are not mixed again at the sinter plant but are forwarded to the blast furnace plant, where they are stored in respective, separate storage bins, and the screened sinter fractions can be intermediately stored in separate bins at the sinter plant, before being forwarded to the blast furnace.

9 Claims, 2 Drawing Sheets

(56) References Cited

FOREIGN PATENT DOCUMENTS

| | | | |
|---|---|---|---|
| CN | 105944965 | A | 9/2016 |
| DE | 2333560 | A1 | 1/1975 |
| DE | 1414321 | A1 | 10/1995 |
| EP | 0302000 | A2 | 2/1989 |
| JP | H01100225 | A | 4/1989 |
| JP | 2011038140 | A | 2/2011 |
| JP | 2015183246 | A | 10/2015 |
| JP | 2017508941 | A | 3/2017 |
| RU | 2518880 | C1 | 6/2014 |

OTHER PUBLICATIONS

Written Opinion dated Jul. 25, 2018 re: Application No. PCT/EP2018/063045, pp. 1-5, citing: DE 23 33 560 A1 and DE 44 14 32 A1.

Eurasian Office Action dated Oct. 20, 2020 re: Application No. 201992731, pp. 1-3, citing: EP 0302000 A2, DE 2333560 A1 and RU 2518880 C1.

CN Office Action dated Apr. 28, 2021 re: Application No. 201880033705.X, pp. 1-12, citing: CN102978313A, CN105944965A, CN104789718A and JP2011038140A.

IN Office Action dated Jun. 22, 2021 re: Application No. 201917047074, pp. 1-5, citing: CN102978313 and CN105944965.

CN Office Action dated Apr. 28, 2021 re: Application No. 201880033705.X, pp. 1-3, citing: CN 102978313A.

JP Office Action dated Mar. 15, 2022 re: Application No. 2019-564512, pp. 1-8, citing: CN102978313, JPH01-100225, JP2017-508941 and JP2015-183246.

* cited by examiner

METHOD OF OPERATING A SINTER PLANT

TECHNICAL FIELD

The present disclosure generally relates to the field of sinter production for the ironmaking industry. More specifically, the present disclosure relates to a method of operating a sinter plant.

BACKGROUND

As it is well known in ferrous metallurgy, the agglomeration of fine ferrous compounds, like fine ores, blast furnace dust (flue dust), steel works waste, mil scale etc., with finely grained fuel (e.g. coke fines) is referred to as the sintering process.

In the sinter plant, the above-mentioned raw materials are stored in bins and a mixture of these feed materials (in predetermined amounts) is subject to a water addition within a so-called mixing and nodularizing drum, in order to produce small rice size nodules or granulates. The obtained raw sinter granulates are transferred to a traveling-grate type sintering furnace. Near the head or feed end of the grate, the bed is ignited on the surface by gas burners, and, as the mixture moves along on the traveling grate, air is pulled down through the mixture to burn the fuel by downdraft combustion. As the grates move continuously over the windboxes toward the discharge end of the strand, the combustion front in the bed moves progressively downward. This creates sufficient heat and temperature, about 1300-1480° C. (2370-2700° F.), to sinter the fine ore particles together into porous clinkers.

After completion of burning in the furnace the obtained sinter cake is at a temperature about 600° C.–700° C. It is broken down into smaller size by means of a sinter breaker and cooled down to a moderate temperature of e.g. 100° C. in a sinter cooler. The cooled product is then passed through a jaw-crusher, where the size of sinter is further reduced into smaller size, namely below 50 mm.

The crushed sinter is screened in order to separate predetermined size fractions, according to operating requirements of the sinter plant. This is illustrated in FIG. 1, which shows that 100% of the fired sinter delivered from the sintering furnace 10 is comminuted to below 50 mm in a comminuting/crusher device 12, and that this crushed sinter is conventionally subjected to screening with high performance screens of 20 mm, 10 mm and 5 mm, respectively indicated 14*a*, 14*b* and 14*c*. By way of this screening system, the crushed sinter is technically separated into four size fractions:

i. the 20 to 50 mm fraction: this larger fraction completely integrates the sinter product.

ii. the 10 to 20 mm fraction: a part of this middle size fraction is required as hearth layer on the grid of the sintering machine. The remainder integrates the sinter product.

iii. the 5 to 10 mm fraction: this is the smaller fraction that completely integrates the sinter product.

iv. the below 5 mm fraction: these fines are recycled to the raw material section (sinter stock house 16) of the sinter plant 18. They are typically not desirable in the blast furnace 22 and will thus not be integrated to the sinter product.

It should be remarked here that upon screening, the three size fractions i), ii) and iii) are mixed together to form the sinter product that is delivered to the blast furnace plant 20. As explained above, this conventional screening process is typically carried for internal operations purposes of the screening plant, in order to remove fines recycled to the raw material sections and to pick a certain proportion of medium sized sinter (fraction ii)) to be used inside the sintering furnace 10.

The final product of the sintering plant 18 is thus a sinter having a size in the range 5-50 mm. It is then forwarded to the blast furnace stock house 24 to be stored in a sinter bin (or silo) 24. During the blast furnace charging sequence, the sinter product is withdrawn from the bin 24 (and preferably screened) onto a material conveyor.

BRIEF SUMMARY

The disclosure provides an improved method of operating a sinter plant.

The present disclosure has arisen from the analysis of the conventional operation of sinter plants, and from consideration of blast furnace charging practices.

As it is known, sinter is a main part of the blast furnace burden. As discussed above, sinter is typically considered in the art as a single product that includes a particle distribution varying from small particles to coarser particles, typically in the range 5 to 50 mm. That is, in typical blast furnace charging programs, sinter is considered as one single product.

By contrast to conventional practice, the present disclosure aims to take advantage of screening operations conventionally achieved at the screening plant not only for the operation of the sinter plant but also for the operation of the blast furnace, in particular by bringing 2 or more sinter fractions to the blast furnace stock house.

Accordingly, the present disclosure proposes a method of operating a sinter plant, wherein a sinter mix is fired in a sintering machine, the method comprising the following steps:

(a) crushing fired sinter to below an upper particle size limit;

(b) screening the crushed sinter to remove fines and separate at least two size fractions;

(c) storing each of said at least two size fractions in a respective, separate storage bin.

Hence in the inventive method the screening plant delivers two or more sinter products of different size classes, which are adequate for use in the sinter plant and the blast furnace plant. Typically, each size fraction separated at step b) has a predetermined particle size range that is distinct from the other fractions without overlapping.

Contrary to conventional practice, the sinter fractions that are separated at the sinter plant are not mixed together but stored intermediately in separate bins (one separated size fraction per bin). As it will be understood, the sinter fractions can be stored intermediately at the sinter plant, before forwarding to the blast furnace plant, or directly forwarded and stored at the blast furnace stockhouse. In an embodiment, one or more fractions are stored and one fraction is directly forwarded to the blast furnace top charging installation.

The present method will be of advantage in blast furnace charging strategies, where for example larger sinter fractions can be used to reduce pressure drop in the blast furnace and fine sinter fractions can be used to control the radial segregation in the blast furnace.

In the inventive method, the sinter fractions separated by the conventional screening operations at step b) are thus preferably directly forwarded to storage bins, to enable charging of size-classified sinter in the blast furnace.

In an embodiment, step (b) includes separating the crushed sinter into an upper size fraction and a lower size fraction.

Preferably however, the crushed sinter is separated into three size fractions: a smaller size fraction, an intermediate size fraction and an upper size fraction. In practice, the intermediate size fraction is returned, at least in part, to the sinter machine as hearth layer, and excess quantities of the intermediate size fraction are stored in a respective, separate storage bin.

The lower size fraction may thus include the small and intermediate size fractions.

These and other features of the disclosure are recited in the appended dependent claims.

According to another aspect, the disclosure concerns a method of operating a blast furnace in a blast furnace plant comprising a blast furnace stock house, wherein the stock house comprises storage bins for sinter. Remarkably, the storage bins for sinter are fed with sinter forwarded from a sinter plant wherein sinter is size-classified according to the method disclosed herein before, at least two sinter size fractions being stored in a respective, separate storage bin. Each size fraction has a predetermined particle size range that is distinct from the other sinter fractions without overlapping. The blast furnace is charged according to a predetermined blast furnace charging sequence implementing sinter size classification.

In practice, sinter from a desired size-class is withdrawn from the corresponding storage bin, and is charged individually (i.e. only one sinter class at a time—but could be mixed with other, non-sinter material) in the blast furnace, to form a sinter layer at a desired location.

BRIEF DESCRIPTION OF THE DRAWINGS

The present disclosure will now be described, by way of example, with reference to the accompanying drawings, in which.

DETAILED DESCRIPTION

Figure 1:
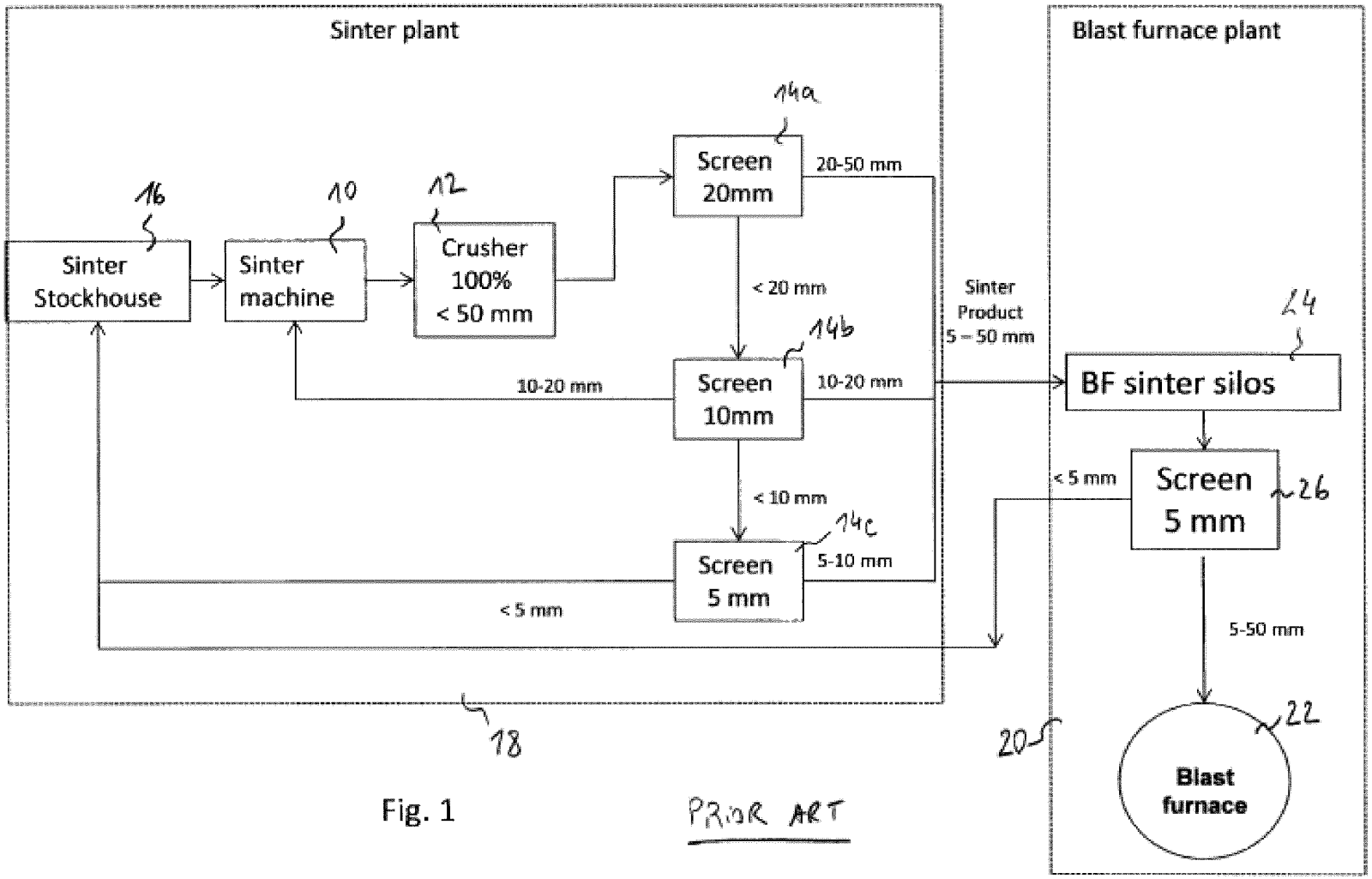
PRIOR ART Fig. 1
FIG. 1: is a flowchart illustrating the delivery of crushed sinter in a prior art sinter plant.

As explained in the background section and summarized in FIG. 1, different sinter size fractions are produced in the conventional sinter plant operation before being mixed again in order to form the final sinter product with a broad particle size distribution.

The present disclosure takes advantage of these different sinter size fractions produced in the conventional sinter plant operation and use them as such in the blast furnace instead of using them in a single product mix. As a result a more flexible blast furnace operation and especially a reduced pressure loss in the blast furnace shaft can be achieved.

Figure 2:
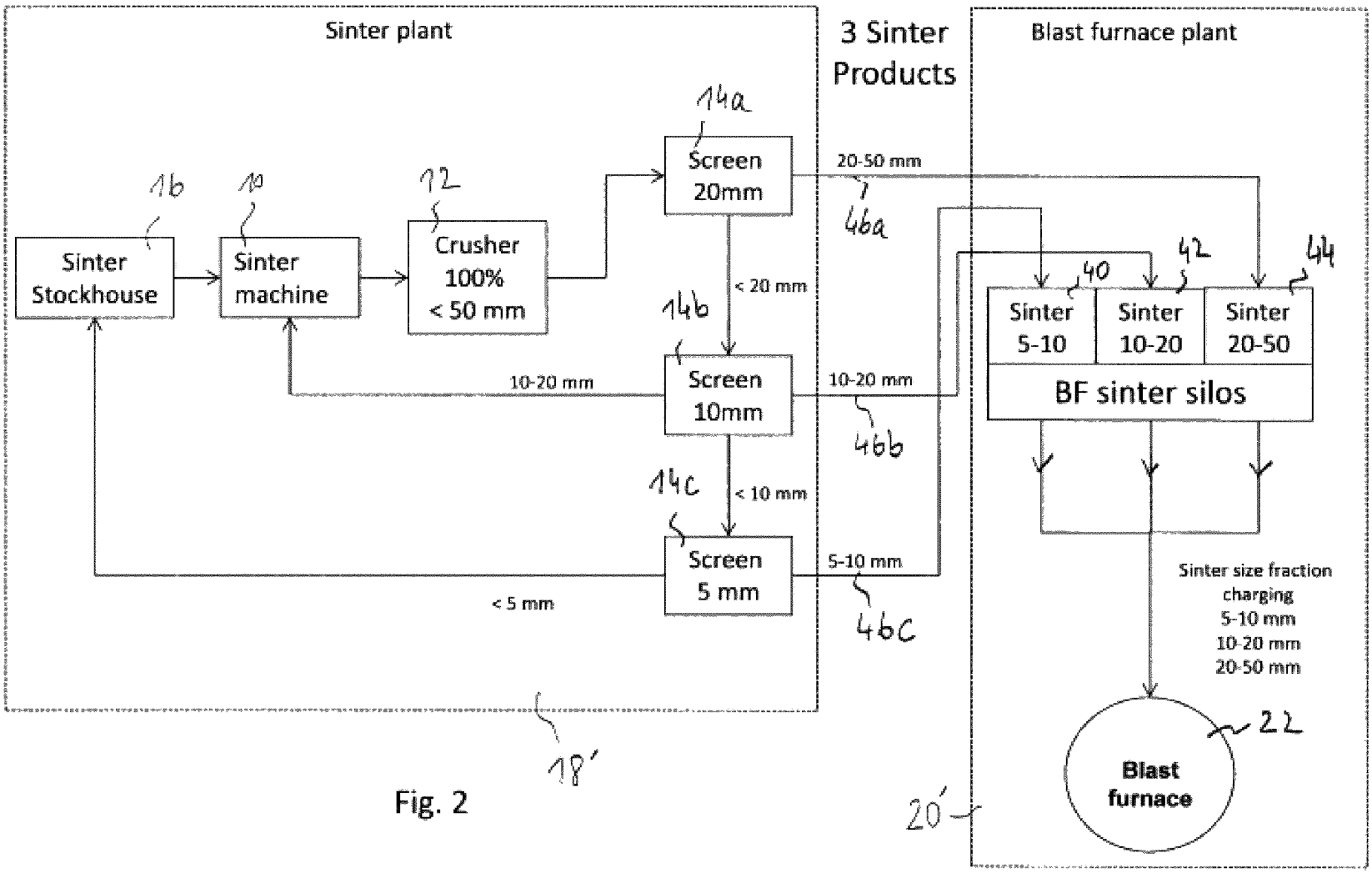
FIG. 2: is a flowchart illustrating an embodiment of the method according to the present disclosure.

An embodiment of the present method will now be described with reference to FIG. 2, where same or similar elements are designated by same reference signs. Sinter plant 18' comprises a sinter stock house 16, a sinter mix preparation section (not shown) to prepare raw sinter nodules or granulates to be fired in the sinter machine 10, as is known in the art and briefly described above in the background art section.

The nodules or granulates are fired (heat treated/hardened) in the sinter machine 10 and the obtained sinter cake is preferably typically broken down into smaller size by means of a sinter breaker and cooled down to a moderate temperature of e.g. 100° C. in a sinter cooler (not shown).

The cooled product is then passed through a comminuting/crusher device 12, where the size of sinter is further reduced into smaller size, here below 50 mm. Crusher device 12 may be any appropriate comminuting or crushing machine, in particular a jaw crusher, toothed crusher or cone crusher. The crushed sinter is subjected to screening with high performance screens of e.g. 20 mm, 10 mm and 5 mm, respectively indicated 14*a*, 14*b* and 14*c*. By way of this screening system, the crushed sinter is technically separated into four size fractions:

i. the 20 to 50 mm fraction, forming the larger class/fraction;
ii. the 10 to 20 mm fraction: a part of this middle size fraction is recycled in the sinter machine as hearth layer;
iii. the 5 to 10 mm fraction, here forming the smaller fraction;
iv. the below 5 mm fraction: these fines are recycled to the raw material section (sinter stock house 16) of the sinter plant 18'.

It shall be appreciated that in the present process, the different size fractions i), ii) and iii) are not re-mixed upon screening in the sinter plant to form a single sinter product, but each size fraction is stored individually in bins (hoppers or silos), e.g. at the blast furnace plant 20'. That is, one separated size fraction is stored in a dedicated bin. In other words, one bin contains only one of the separated size fractions, but there can be two or more bins containing the same size fraction.

Reference signs 40, 42 and 44 designate such separate sinter hoppers provided to contain given size fractions of sinter as obtained from the screens 14*a*, 14*b* and 14*c* of the sinter plant 18'.

It shall be noticed that the screening is carried out in such a way that the different sinter fractions (or size classes) are distinct from each other and do not overlap. Hence, the blast furnace plant comprises bins 40, 42 and 44 comprising different size sinter fraction, which will allow blast furnace charging strategies implementing sinter size classification.

In the present embodiment, the three bins 40, 42 and 44 may be typically arranged in the blast furnace stock house, where:

bin 40 contains the 5-10 mm sinter fraction;
bin 42 contains the 10-20 mm sinter fraction;
bin 44 contains the 20-50 mm sinter fraction.

For example, the screened sinter fraction is directly forwarded from the screens 14*a*, 14*b*, and 14*c* to the respective bins 40, 42 and 44 via dedicated, respective conveyor arrangements 46*a*, 46*b*, 46*c*. Conventionally, a fines-screen can be arranged to remove fines particles, e.g. below 5 mm, when drawing the size-classified sinter from the respective bins 40, 42, 44.

The availability of different size classes of sinter in separate bins at the blast furnace stock house allows charging size-classified sinter into the blast furnace. That is, layers of sinter from a desired size-class can be charged individually in the blast furnace, at desired locations in the furnace.

Overall, charging size-classified sinter in the blast furnace will allow charging sinter of different particle size class (as discharged from the bins 40, 42 or 43) into different radial positions of the blast furnace and thereby adjust gas flow distribution.

Some of the benefits of the present disclosure are summarized below.

Increasing the void in the sinter fraction in the blast furnace (BF) allowing flexible utilization according to user situation, for example:

Increase in BF productivity,

Use of finer sinter fractions reducing the return fine rate,

Allow reduced sinter quality in BF, with the possibility of using low cost sinter raw materials, Use of cheaper coke.

Better control of radial segregation due to reduced grain size variation in each sinter fraction/class results in better process control of the BF, providing:

increased BF process stability, reduced coke consumption and better cooling element protection.

The invention claimed is:

1. A method of operating a blast furnace in a blast furnace plant comprising a blast furnace stock house, wherein said stock house includes storage bins for sinter, wherein said storage bins for sinter are fed with sinter forwarded from a sinter plant, said sinter being size-classified according to a method of operating the sinter plant, wherein a sinter mix is fired in a sintering machine, said method comprising the following steps:

(a) crushing fired sinter to below an upper particle size limit in the range of 40 to 100 mm;

(b) screening the crushed sinter to remove fines and separate at least two sinter size fractions; and (c) storing each of said at least two sinter size fractions in a respective, separate storage bin, wherein each size fraction has a predetermined particle size range that is distinct from the other sinter fractions without overlapping;

wherein said blast furnace is charged according to a predetermined blast furnace charging sequence implementing sinter size classification; and wherein sinter from a desired size fraction, as withdrawn from the corresponding storage bin, is charged separately from other size fractions in the blast furnace, to form a material layer at a desired location.

2. The method according to claim 1, wherein step (b) further comprises separating an intermediate size fraction that is returned, at least in part, to the sintering machine as hearth layer, excess quantities of said intermediate size fraction being stored in a respective, separate storage bin.

3. The method according to claim 2, wherein said lower size fraction includes said intermediate size fraction and a smaller size fraction.

4. The method according to claim 3, wherein said upper size fraction includes sinter particles having a size in the range of about 20 to 50 mm; said intermediate size fraction includes sinter particles having a size in the range of about 10 to 20 mm; and said smaller fraction includes sinter particles having a size in the range of about 5 to 10 mm.

5. The method according to claim 1, wherein said upper and lower size fractions are directly stored after said screening step b).

6. The method according to claim 1, wherein at step b) crushed sinter is passed through screening units and step c) comprises collecting the screened sinter fractions to directly forward them to the storage bins.

7. The method according to claim 1, wherein said storage bins are part of a blast furnace stock house and the screened sinter fractions are directly forwarded to said storage bins.

8. The method according to claim 1, wherein said storage bins are part of the sinter plant and screened sinter fractions are intermediately stored therein before being forwarded to a blast furnace charging installation or blast furnace stockhouse storage bins.

9. The method according to claim 1, wherein removed fines have a particle size in the range of 2 to 8 mm.

* * * * *